US008019276B2

(12) United States Patent
Phillips

(10) Patent No.: US 8,019,276 B2
(45) Date of Patent: Sep. 13, 2011

(54) AUDIO TRANSMISSION METHOD AND SYSTEM

(75) Inventor: Christopher Phillips, Hampshire (GB)

(73) Assignee: International Business Machines Corporation, Armonk, NY (US)

( * ) Notice: Subject to any disclaimer, the term of this patent is extended or adjusted under 35 U.S.C. 154(b) by 745 days.

(21) Appl. No.: 12/131,197

(22) Filed: Jun. 2, 2008

(65) Prior Publication Data

US 2009/0298417 A1 Dec. 3, 2009

(51) Int. Cl.
*H04H 60/09* (2008.01)

(52) U.S. Cl. ..... 455/3.04; 455/3.01; 455/414.1; 455/414.4; 455/552.1; 704/271; 704/257; 704/258

(58) Field of Classification Search ..... 455/3.01, 455/3.03, 3.04, 414.1, 414.4, 418, 420, 507, 455/552.1; 704/270, 271, 257, 246, 251, 704/231, 752, 270.1, 258; 725/32
See application file for complete search history.

(56) References Cited

U.S. PATENT DOCUMENTS

| | | | | |
|---|---|---|---|---|
| 6,606,596 | B1 * | 8/2003 | Zirngibl et al. | 704/270 |
| 6,823,312 | B2 * | 11/2004 | Mittal et al. | 704/271 |
| 7,822,606 | B2 * | 10/2010 | Lane et al. | 704/258 |
| 2003/0077065 | A1 * | 4/2003 | Scholten et al. | 386/46 |
| 2008/0015860 | A1 * | 1/2008 | Lane et al. | 704/258 |
| 2009/0158318 | A1 * | 6/2009 | Levy | 725/32 |

FOREIGN PATENT DOCUMENTS

EP 1185138 A2 3/2002

* cited by examiner

*Primary Examiner* — Tan Trinh
(74) *Attorney, Agent, or Firm* — Schmeiser, Olsen & Watts; Michael J. LeStrange

(57) ABSTRACT

An audio transmission method and system. The method includes detecting by a computing system, a wireless device belonging to a user. The computing system enables a connection between the wireless device and the computing system. The computing system receives from the wireless device, a request for receiving an audio broadcast. The computing system transmits to the wireless device, a language list comprising different languages for the audio broadcast. The computing system receives from the wireless device, a selection for a first language from the language list. The computing system transmits a message indicating the selection to the wireless device. The computing system requests the audio broadcast. The computing system receives the audio broadcast. The computing system transmits the audio broadcast comprising the first language to the wireless device.

21 Claims, 3 Drawing Sheets

AUDIO TRANSMISSION METHOD AND SYSTEM

FIELD OF THE INVENTION

The present invention relates to a method and associated system for translating and transmitting an audio broadcast.

BACKGROUND OF THE INVENTION

Transmitting selectable data files typically comprises an inaccurate process with little flexibility. Accordingly, there exists a need in the art to overcome at least some of the deficiencies and limitations described herein above.

SUMMARY OF THE INVENTION

The present invention provides a method comprising:

detecting, by a computing system, a first wireless device belonging to a first user;

enabling, by said computing system in response to said detecting said first wireless device, a first connection between said first wireless device and said computing system;

after said enabling said first connection, receiving by said computing system from said first wireless device, a first request for receiving an audio broadcast;

transmitting, by said computing system to said first wireless device in response to said receiving said first request, a language list comprising a plurality of different languages for said audio broadcast;

receiving, by said computing system from said first wireless device, a first selection for a first language from said language list;

transmitting, by said computing system to said first wireless device, a first message indicating said first selection;

transmitting, by said computing system to an audio source, a first request for said audio broadcast;

receiving, by said computing system from said audio source in response to said first request, said audio broadcast; and transmitting, by said computing system to said first wireless device, said audio broadcast in said first language.

The present invention provides a computing system comprising a processor coupled to a computer-readable memory unit, said memory unit comprising instructions that when executed by the processor implements an audio transmission method, said method comprising:

detecting, by said computing system, a first wireless device belonging to a first user;

enabling, by said computing system in response to said detecting said first wireless device, a first connection between said first wireless device and said computing system;

after said enabling said first connection, receiving by said computing system from said first wireless device, a first request for receiving an audio broadcast;

transmitting, by said computing system to said first wireless device in response to said receiving said first request, a language list comprising a plurality of different languages for said audio broadcast;

receiving, by said computing system from said first wireless device, a first selection for a first language from said language list;

transmitting, by said computing system to said first wireless device, a first message indicating said first selection;

transmitting, by said computing system to an audio source, a first request for said audio broadcast;

receiving, by said computing system from said audio source in response to said first request, said audio broadcast; and transmitting, by said computing system to said first wireless device, said audio broadcast in said first language.

The present invention advantageously provides a simple method and associated system capable of transmitting selectable data files.

DETAILED DESCRIPTION OF THE INVENTION

Figure 1:
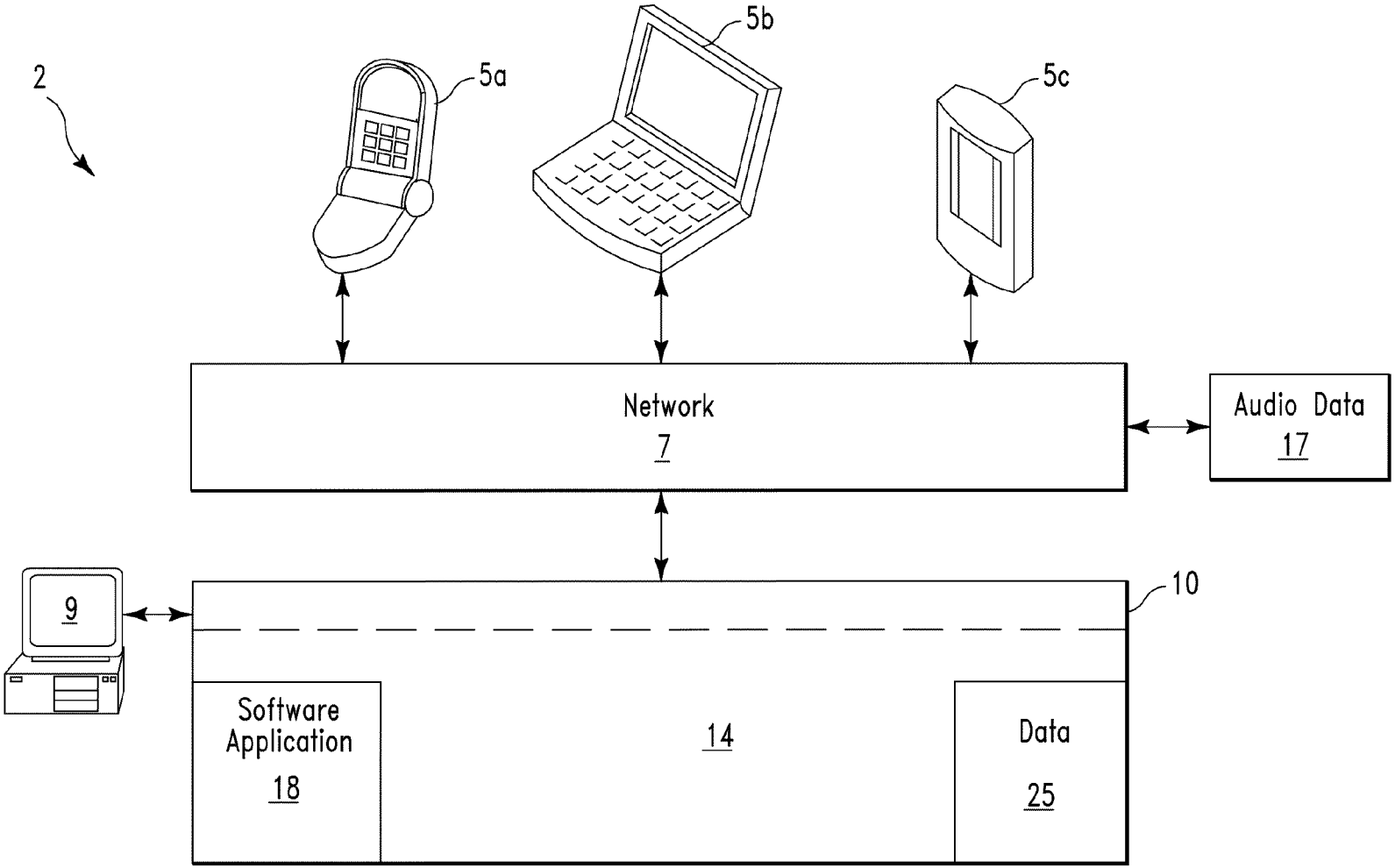
FIG. 1 illustrates a system for transmitting an audio broadcast to electronic devices, in accordance with embodiments of the present invention.

FIG. 1 illustrates a system 2 for transmitting an audio broadcast to any of electronic devices 5*a* . . . 5*c*, in accordance with embodiments of the present invention. An electronic device (e.g., electronic devices 5*a* . . . 5*c*) is defined herein as a device capable of generating, transmitting, and receiving electrical signals. Electronic devices 5*a* . . . 5*c* may comprise any type of electronic device including, inter alia, a cellular telephone (e.g., electronic device 5*a*), a personal digital assistant (PDA) (e.g., electronic device 5*c*), an audio/video device (e.g., an MP3 player/phone, etc), a computer (e.g., electronic device 5*c*), etc. Electronic devices 5*a* . . . 5*c* may comprise wireless devices. System 2 is used to receive an audio broadcast from an event and broadcast audio data 17 from the event (i.e., for a user) in a language selected by a user. The event may comprise any event including, inter alia, a movie, a concert, a conference, a live speech, etc. System 2 may perform the following functions associated with the audio broadcast from the event:

1. A user activates an electronic device (e.g., electronic devices 5*a* . . . 5*c*) to subscribe to an audio broadcast (e.g., a movie) over a wireless link (e.g. Wife, Bluetooth, LMDS, MMDS, eetc).
2. The user is given an option to select a language for the audio broadcast.
3. The user selects a language.
4. The audio broadcast is broadcast through a public address system (e.g., a PA system fir a theater).
5. The PA system simultaneously passes audio data 17 to: speakers, an optional translator, computing system 10, and a wireless delivery device.
6. The audio broadcast is translated into the language selected by the user.
7. The translated audio broadcast is transmitted to the electronic device belonging to the user.
8. The electronic device amplifies the translated audio broadcast for the user.

System 2 of FIG. 1 comprises electronic devices 5*a* . . . 5*c* and an event (i.e., comprising audio data 17) connected to a computing system 10 through a network 7. Audio data 17 may comprise any audio data associated with an event (e.g., audio from a movie, concert, speech, etc). Network 7 may comprise any type of network including, inter alia, a local area network, (LAN), a wide area network (WAN), the Internet, etc. Network 7 may comprise a wireless network. Computing system 10 may comprise any type of computing system(s) including, inter alia, a personal computer (PC), a server computer, a database computer, etc. Computing system 10 may comprise a single computing system or a plurality of computing systems. Computing system 10 comprises a memory system 14 (e.g., a database). Memory system 14 may comprise a single memory system. Alternatively, memory system 14 may comprise a plurality of memory systems. Memory system 14 may be internal to computing system (e.g., as illustrated in FIG. 1) or external to computing system 10. Memory system 14 comprises a software application 18 and data 25. System 2 may comprise an optional access terminal 9 connected to computing system 10. Access terminal 9 may be used by a translator for translating audio data 17 into the user selected language. Alternatively, computing system 10 may automatically (i.e., in response to a user command) translate audio data 17 into a user selected language. Software application 18 controls all functions associated with retrieving, translating, and transmitting audio data 17 to devices 5*a* . . . 5*c*.

The following process steps illustrate an implementation example (i.e., associated with a cinema event) for executing software application 18 to enable a process for translating and transmitting an audio broadcast (i.e., audio data 17) to any of electronic devices 5*a* . . . 5*c*:

1. A public address (PA) system is enabled.
2. A streaming server is enabled (e.g., a portion of computing system 10).
3. A Web server is enabled (e.g., a portion of computing system 10).
4. A wireless interface (Wife point) is enabled.
5. The streaming server initializes.
6. All available languages (i.e., for translating audio data 17) are detected.
7. Multiple listener threads are enabled.
8. A user enters a cinema to view a movie.
9. The user uses one of devices 5*a* . . . 5*c* to register an interest using the Web server of computing system 10.
10. The server detects the user using one of its multiple listener threads.
11. The server transmits a response to the user. The response comprises a Webpage with links to the available languages detected in step 6.

A. If the user doesn't receive a response within 10 seconds the request is transmitted again.

12. The user transmits a receipt for the transaction of step 11.

A. If the server doesn't receive a response within 10 seconds the request is transmitted again.

13. The user selects a language (i.e., from the Webpage with links) for listening to the film using the following the following steps:

A. The user clicks on a link (i.e., on the webpage) for their desired language.

B. The user transmits the selection to the server.

C. The server transmits a receipt for this transaction.

a. If the user doesn't receive a response within 10 seconds, the request is transmitted again.

14. Computing system 10 or a translator (i.e., via access terminal 9) translates audio data 17 in accordance with the selection of step 13.
15. The server transmits the translated audio stream (audio data 17) to one of electronic devices 5*a* . . . 5*c*.
16. The user (i.e., upon receiving audio data 17) transmits a receipt to the server.
17. During the transmission of the translated audio stream (audio data 17), the user maintain communications with the server in order to confirm a status of both the user and the server.
18. Upon completion of the end of the movie, the server will transmit an "end of stream" message and so that the user will know the movie has completed.

Figure 2:
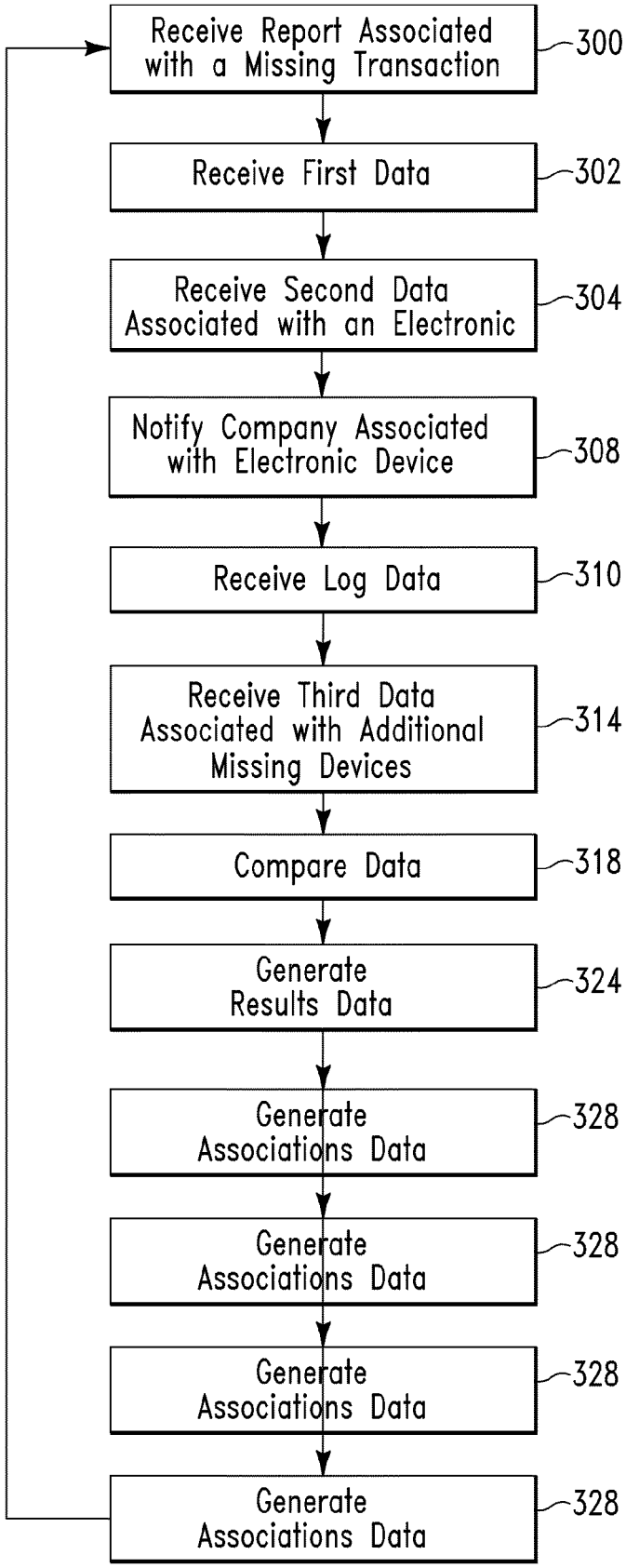
FIG. 2 illustrates a flowchart describing an algorithm used by the system of FIG. 1 for translating and transmitting an audio broadcast to electronic devices, in accordance with embodiments of the present invention.

FIG. 2 illustrates a flowchart describing an algorithm used by system 2 of FIG. 1 for translating and transmitting an audio broadcast to electronic devices, in accordance with embodiments of the present invention. In step 200, a user enters an event (e.g., a theater, a concert, a speaking event, etc) and a computing system (e.g., computing system 10 of FIG. 1) detects a wireless device (e.g., one of electronic devices 5*a* . . . 5*c* of FIG. 1) belonging to the user. In step 202, the computing system (i.e., in response to step 200) enables a connection between the wireless device and the computing system. Step 202 may comprise a multiple step login process using a user name and password. In step 204, the computing system receives a request for receiving an audio broadcast (e.g., audio data 17 of FIG. 1) associated with the event. In step 208, the computing system transmits a language list or Webpage comprising executable language links to the user (i.e., vie the wireless device). The language list or Webpage comprising the language links comprises selectable languages for translating the audio broadcast into another language (i.e., differing from the original language of the audio broadcast). In step 210, the user selects a language from the language list or Webpage comprising language links. The language selection is transmitted to the computing system. In step 214, the computing system transmits a message to the user (i.e., vie the wireless device). The message indicates the language selection. In step 218, the computing system transmits to an audio source, a request for receiving the audio broadcast. In step 224, the computing system receives (i.e., from the audio source) the requested audio broadcast. In step 228, the audio broadcast is converted into a language selected in step 210. The converted language differs from an original language of the audio broadcast. The audio broadcast may be converted into the language selected in step 210 by the following two methods:

1. A translator may receive the audio broadcast from the computing system (e.g., via access terminal 9 of FIG. 1), translate the audio broadcast into the selected language, and transmit the translated audio broadcast back to the computing system.
2. The computing system 10 may automatically (i.e., in response to the user language selection) translate (e.g., via a speech recognition and auto translation process) the audio broadcast into the user selected language.

In step 234, the translated audio broadcast is transmitted to the user via the wireless device. In step 238, the computing system monitors the wireless device to determine when the audio broadcast has completed. Alternatively or additionally, the computing system may monitor the wireless device to determine if a specified percentage of the audio broadcast has completed (e.g., 25%, 75%, etc). In this case, a remaining time for completion may be calculated. In step 242, the computing system generates a completion message (i.e., associated with the audio broadcast) and/or the remaining time for completion of the audio broadcast. The completion message and/or the remaining time for completion of the audio broadcast are transmitted to the user via the wireless device. The process may be repeated for the same user (e.g., for a different event) or a different user for the same event. The process described by the algorithm of FIG. 2 may be executed simultaneously for multiple users using multiple wireless devices.

Figure 3:
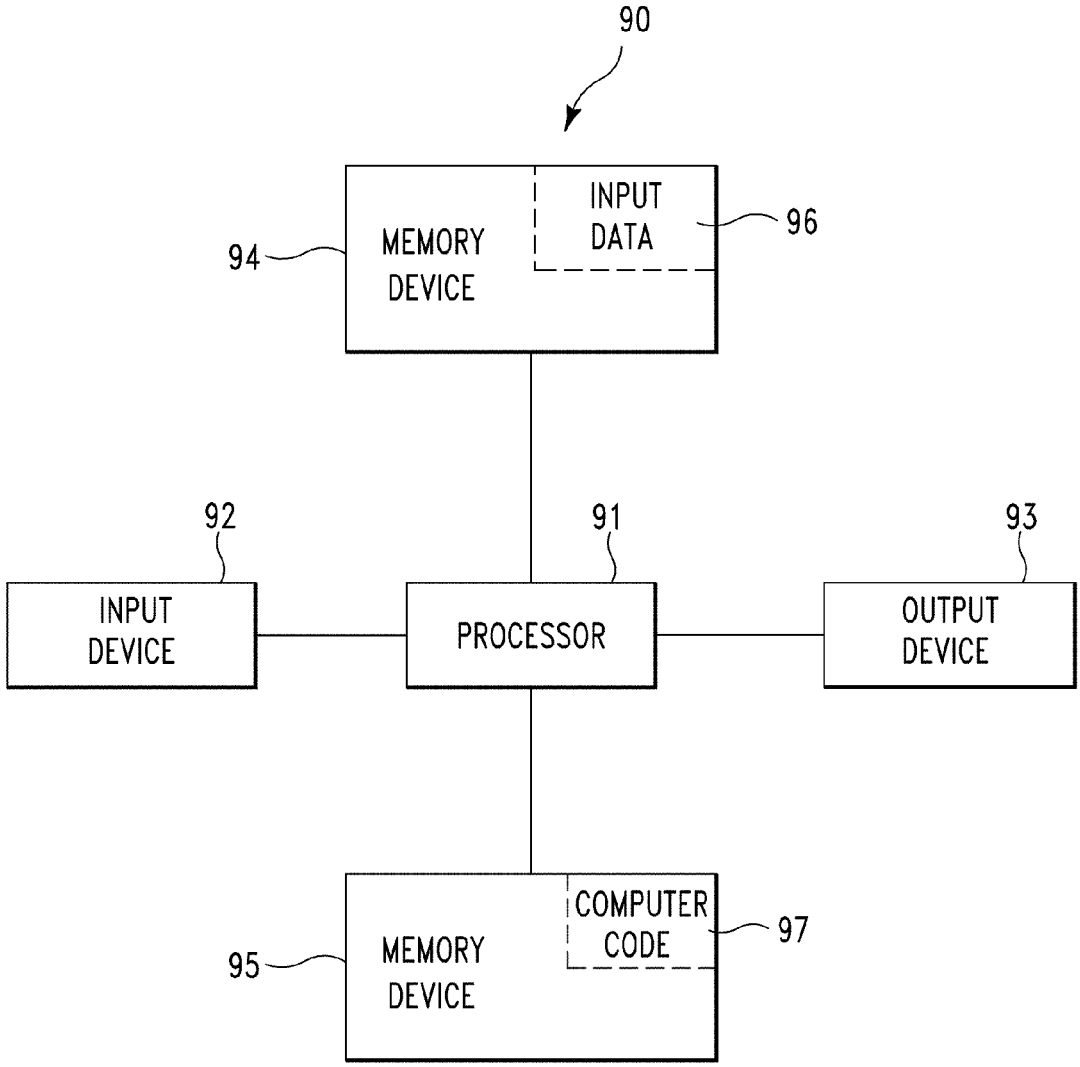
FIG. 3 illustrates a computer apparatus used for translating and transmitting an audio broadcast to electronic devices, in accordance with embodiments of the present invention.

FIG. 3 illustrates a computer apparatus 90 (e.g., computing system 10 of FIG. 1) used for translating and transmitting an audio broadcast to electronic devices, in accordance with embodiments of the present invention. The computer system 90 comprises a processor 91, an input device 92 coupled to the processor 91, an output device 93 coupled to the processor 91, and memory devices 94 and 95 each coupled to the processor 91. The input device 92 may be, inter alia, a keyboard, a mouse, etc. The output device 93 may be, inter alia, a printer, a plotter, a computer screen, a magnetic tape, a removable hard disk, a floppy disk, etc. The memory devices 94 and 95 may be, inter alia, a hard disk, a floppy disk, a magnetic tape, an optical storage such as a compact disc (CD) or a digital video disc (DVD), a dynamic random access memory (DRAM), a read-only memory (ROM), etc. The memory device 95 includes a computer code 97. The computer code 97 includes algorithms (e.g., the algorithm of FIG. 2) for translating and transmitting an audio broadcast to electronic devices. The processor 91 executes the computer code 97. The memory device 94 includes input data 96. The input data 96 includes input required by the computer code 97. The output device 93 displays output from the computer code 97. Either or both memory devices 94 and 95 (or one or more additional memory devices not shown in FIG. 3) may comprise the algorithm of FIG. 2 and may be used as a computer usable medium (or a computer readable medium or a program storage device) having a computer readable program code embodied therein and/or having other data stored therein, wherein the computer readable program code comprises the computer code 97. Generally, a computer program product (or, alternatively, an article of manufacture) of the computer system 90 may comprise said computer usable medium (or said program storage device).

Still yet, any of the components of the present invention could be created, integrated, hosted, maintained, deployed, managed, serviced, etc. by a service provider who offers to translate and transmit an audio broadcast to electronic devices. Thus the present invention discloses a process for deploying, creating, integrating, hosting, maintaining, and/or integrating computing infrastructure, comprising integrating computer-readable code into the computer system 90, wherein the code in combination with the computer system 90 is capable of performing a method for translating and transmitting an audio broadcast to electronic devices. In another embodiment, the invention provides a business method that performs the process steps of the invention on a subscription, advertising, and/or fee basis. That is, a service provider, such as a Solution Integrator, could offer to perform a process for translating and transmitting an audio broadcast to electronic devices. In this case, the service provider can create, maintain, support, etc. a computer infrastructure that performs the process steps of the invention for one or more customers. In return, the service provider can receive payment from the customer(s) under a subscription and/or fee agreement and/or the service provider can receive payment from the sale of advertising content to one or more third parties.

While FIG. 3 shows the computer system 90 as a particular configuration of hardware and software, any configuration of hardware and software, as would be known to a person of ordinary skill in the art, may be utilized for the purposes stated supra in conjunction with the particular computer system 90 of FIG. 3. For example, the memory devices 94 and 95 may be portions of a single memory device rather than separate memory devices.

While embodiments of the present invention have been described herein for purposes of illustration, many modifications and changes will become apparent to those skilled in the art. Accordingly, the appended claims are intended to encompass all such modifications and changes as fall within the true spirit and scope of this invention.

What is claimed is:

1. A method comprising:

detecting, by a computing system, a first wireless device belonging to a first user;

enabling, by said computing system in response to said detecting said first wireless device, a first connection between said first wireless device and said computing system;

after said enabling said first connection, receiving by said computing system from said first wireless device, a first request for receiving an audio broadcast;

transmitting, by said computing system to said first wireless device in response to said receiving said first request, a language list comprising a plurality of different languages for said audio broadcast;

receiving, by said computing system from said first wireless device, a first selection for a first language from said language list;

transmitting, by said computing system to said first wireless device, a first message indicating said first selection;

transmitting, by said computing system to an audio source, a first request for said audio broadcast;

receiving, by said computing system from said audio source in response to said first request, said audio broadcast; and transmitting, by said computing system to said first wireless device, said audio broadcast in said first language.

2. The method of claim 1, further comprising:

monitoring, by said computing system, said first wireless device during said transmitting audio broadcast in said first language;

determining, by said computing system based on said monitoring, that said transmitting said audio broadcast in said first language has completed;

generating, by said computing system, a completion message indicating that said transmitting said audio broadcast in said first language has completed; and transmitting, by said computing system to said first wireless device, said completion message.

3. The method of claim 1, further comprising:

monitoring, by said computing system, said first wireless device during said transmitting audio broadcast in said first language;

determining, by said computing system based on said monitoring, that a specified percentage of said transmitting said audio broadcast in said first language has completed;

calculating, by said computing system based on said specified percentage, a remaining time for said transmitting said audio broadcast in said first language; and transmitting, by said computing system to said first wireless device, said remaining time.

4. The method of claim 1, wherein said first language differs from an original language of said audio broadcast.

5. The method of claim 1, wherein said transmitting said language list to said first wireless device comprises transmitting a Web page comprising said language list, wherein said language list comprises executable links, and wherein each link of said executable links is associated with a different language of said plurality of languages.

6. The method of claim 1, wherein said audio broadcast is received by said computing system in an original language, wherein said first language differs from said original language, and wherein said method further comprises:

converting, by said computing system, said audio broadcast in said original language to said audio broadcast in said first language.

7. The method of claim 1, wherein said audio broadcast is received by said computing system in said first language.

8. The method of claim 1, further comprising:

detecting, by a computing system, a second wireless device belonging to a second user;

enabling, by said computing system in response to said detecting said second wireless device, a second connection between said second wireless device and said computing system;

after said enabling said second connection, receiving by said computing system from said second wireless device, a second request for receiving an audio broadcast;

transmitting, by said computing system to said second wireless device in response to said receiving said second request, said language list comprising said plurality of different languages for said audio broadcast;

receiving, by said computing system from said second wireless device, a second selection for a second language from said language list, wherein said second language differs from said first language;

transmitting, by said computing system to said second wireless device, a second message indicating said second selection;

transmitting, by said computing system to said audio source, a second request for said audio broadcast;

receiving, by said computing system from said audio source in response to said second request, said audio broadcast; and transmitting, by said computing system to said second wireless device, said audio broadcast in said second language.

9. The method of claim 1, wherein said audio broadcast comprises audio data retrieved from an event selected from the group consisting of a movie, a concert, a conference, and a live speech.

10. The method of claim 1, wherein said first wireless device comprises a device selected from the group consisting of a cellular telephone, a personal digital assistant, and a notebook computer.

11. A computer program product, comprising a computer storage medium comprising a computer readable program code embodied therein, said computer readable program code configured to perform the method of claim 1 upon being executed by a processor of said computing system.

12. A computing system comprising a processor coupled to a computer-readable memory unit, said memory unit comprising instructions that when executed by the processor implements an audio transmission method, said method comprising:

detecting, by said computing system, a first wireless device belonging to a first user;

enabling, by said computing system in response to said detecting said first wireless device, a first connection between said first wireless device and said computing system;

after said enabling said first connection, receiving by said computing system from said first wireless device, a first request for receiving an audio broadcast;

transmitting, by said computing system to said first wireless device in response to said receiving said first request, a language list comprising a plurality of different languages for said audio broadcast;

receiving, by said computing system from said first wireless device, a first selection for a first language from said language list;

transmitting, by said computing system to said first wireless device, a first message indicating said first selection;

transmitting, by said computing system to an audio source, a first request for said audio broadcast;

receiving, by said computing system from said audio source in response to said first request, said audio broadcast; and transmitting, by said computing system to said first wireless device, said audio broadcast in said first language.

13. The computing system of claim 12, wherein said method further comprises:

monitoring, by said computing system, said first wireless device during said transmitting audio broadcast in said first language;

determining, by said computing system based on said monitoring, that said transmitting said audio broadcast in said first language has completed;

generating, by said computing system, a completion message indicating that said transmitting said audio broadcast in said first language has completed; and transmitting, by said computing system to said first wireless device, said completion message.

14. The computing system of claim 12, wherein said method further comprises:

monitoring, by said computing system, said first wireless device during said transmitting audio broadcast in said first language;

determining, by said computing system based on said monitoring, that a specified percentage of said transmitting said audio broadcast in said first language has completed;

calculating, by said computing system based on said specified percentage, a remaining time for said transmitting said audio broadcast in said first language; and transmitting, by said computing system to said first wireless device, said remaining time.

15. The computing system of claim 12, wherein said first language differs from an original language of said audio broadcast.

16. The computing system of claim 12, wherein said transmitting said language list to said first wireless device comprises transmitting a Web page comprising said language list, wherein said language list comprises executable links, and wherein each link of said executable links is associated with a different language of said plurality of languages.

17. The computing system of claim 12, wherein said audio broadcast is received by said computing system in an original language, wherein said first language differs from said original language, and wherein said method further comprises:

converting, by said computing system, said audio broadcast in said original language to said audio broadcast in said first language.

18. The computing system of claim 12, wherein said audio broadcast is received by said computing system in said first language.

19. The computing system of claim 12, wherein said method further comprises:

enabling, by said computing system in response to said detecting said second wireless device, a second connection between said second wireless device and said computing system;

after said enabling said second connection, receiving by said computing system from said second wireless device, a second request for receiving an audio broadcast;

transmitting, by said computing system to said second wireless device in response to said receiving said second request, said language list comprising said plurality of different languages for said audio broadcast;

receiving, by said computing system from said second wireless device, a second selection for a second language from said language list, wherein said second language differs from said first language;

transmitting, by said computing system to said second wireless device, a second message indicating said second selection;

transmitting, by said computing system to said audio source, a second request for said audio broadcast;

receiving, by said computing system from said audio source in response to said second request, said audio broadcast; and transmitting, by said computing system to said second wireless device, said audio broadcast in said second language.

20. The computing system of claim 12, wherein said audio broadcast comprises audio data retrieved from an event selected from the group consisting of a movie, a concert, a conference, and a live speech.

21. The computing system of claim 12, wherein said first wireless device comprises a device selected from the group consisting of a cellular telephone, a personal digital assistant, and a notebook computer.

* * * * *